United States Patent [19]

McLarty

[11] 4,022,548

[45] May 10, 1977

[54] AIR CIRCULATING FAN AND MOTOR WITH SEPARABLE SAFETY GUARD

[76] Inventor: Gordon McLarty, 209 W. Jefferson St., Augusta, Mich. 49012

[22] Filed: Apr. 2, 1976

[21] Appl. No.: 672,987

[52] U.S. Cl. ..... 416/247 R; 415/121 G; 417/411

[51] Int. Cl.[2] ..... F04D 29/32

[58] Field of Search ..... 416/247; 417/411, 234, 417/361; 415/121 G

[56] References Cited

UNITED STATES PATENTS

| | | | |
|---|---|---|---|
| 2,345,516 | 3/1944 | Weber | 416/247 X |
| 2,617,583 | 11/1952 | Kemler | 416/247 |
| 2,624,504 | 1/1953 | Viewegh | 416/247 |
| 2,728,519 | 12/1955 | McLarty | 416/247 |
| 3,725,640 | 4/1973 | Kunz | 415/121 G X |
| 3,787,142 | 1/1974 | Dupke | 416/247 |

FOREIGN PATENTS OR APPLICATIONS

| | | | |
|---|---|---|---|
| 1,041,632 | 10/1953 | France | 415/121 G |
| 625,522 | 2/1936 | Germany | 416/247 |

OTHER PUBLICATIONS

Des. 135,211 3–1943, Weber, (U.S. Design Patent).

*Primary Examiner*—Everette A. Powell, Jr.

[57] ABSTRACT

The open wire grid safety guard enclosure for a fan and its motor is rectangular box-like in shape and is made up of two substantially identical halves.

Each half is made from identical cruciform blanks of grid mesh wires with parallel closely spaced wires extending in one direction and connected by more widely spaced cross wires, including marginal cross wires at the ends of the arms of the cross form. The arms of the cross form are bent inwardly of the box form through an angle of about 105° from the planes of the centers of the blank. Hinge means connect the opposed marginal wires along one side edge of the box and are recessed inwardly of the planes of the outer edges of the sides by the angle of the bent arms. Releasable latch means connect other marginal wires at points spaced from the side with the hinge means. A plate welded to the center of one side of the box carries supporting connections to a fan motor and fan blade enclosed in the box. A hanger loop releasably connects the adjacent edges of the box opposite the hinge means.

2 Claims, 6 Drawing Figures

AIR CIRCULATING FAN AND MOTOR WITH SEPARABLE SAFETY GUARD

OUTLINE OF INVENTION

Fans have been protected for a long time by guard wires of various arrangement. However, recently promulgated safety regulations require that access to any and all parts of a fan blade, from any direction, be limited by guards which provide openings of no more than half an inch wide. This means that a grid or mesh with small openings must surround the rotating space of a fan. When the driving motor is enclosed with the fan, as has been done in the past, the small size grid openings make it difficult to clean the fan blades and inside the guard wires and lubricate the motor as is required periodically.

The present invention provides a box-like safety guard which can be easily and economically fabricated from two substantially identical and mass producible grids of crossing wires. It is an incident of the invention that the motor of the fan is attachable to one wall of the box by use of a slotted plate welded to the wall. This permits one size of guard box to receive motors with differently spaced mounting screws.

DETAILED DESCRIPTION

The drawings of which there are two sheets illustrate a preferred form of the guard with the fan and motor therein.

It is first pointed out that the fan and its guard may be oriented with any of the six flat sides of the grid box on a supporting surface. It may also be suspended or hung from one or two hooks on a wall, so terms such as "top," "bottom," "front," "back," "side" and "end" are relative. However, for the purpose of description, the surface shown in elevation in FIG. 1 will be referred to as the front wall, with a back wall opposite. The top end is shown in FIG. 2 with the bottom end opposite, and the support for the fan on the back wall is shown. Right and left sides refer to the corresponding sides of FIGS. 1 and 2.

Figure 1:
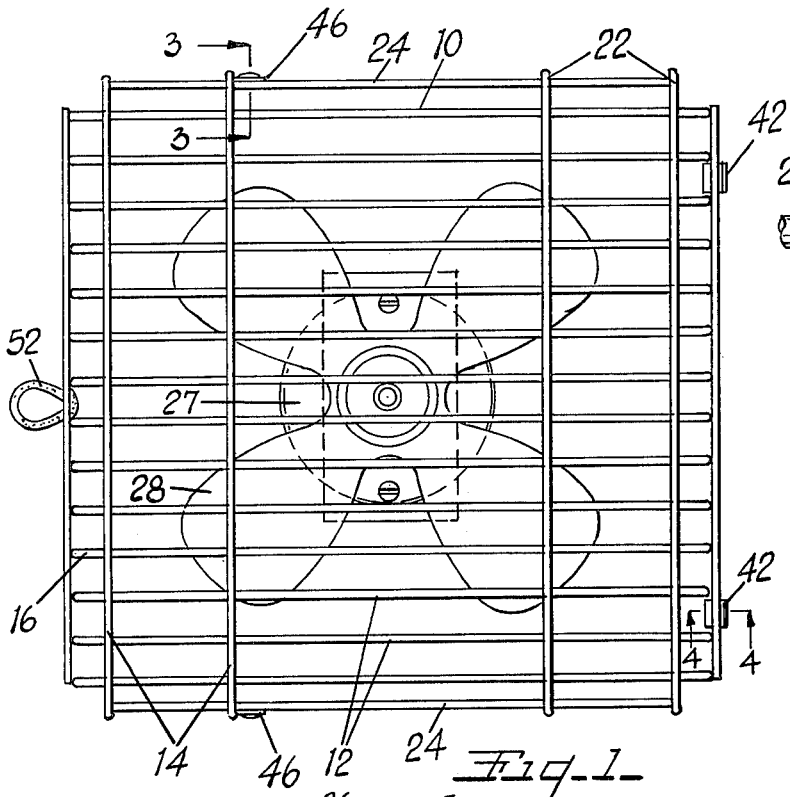
FIG. 1 is a front elevational view of the fan.
Figure 2:
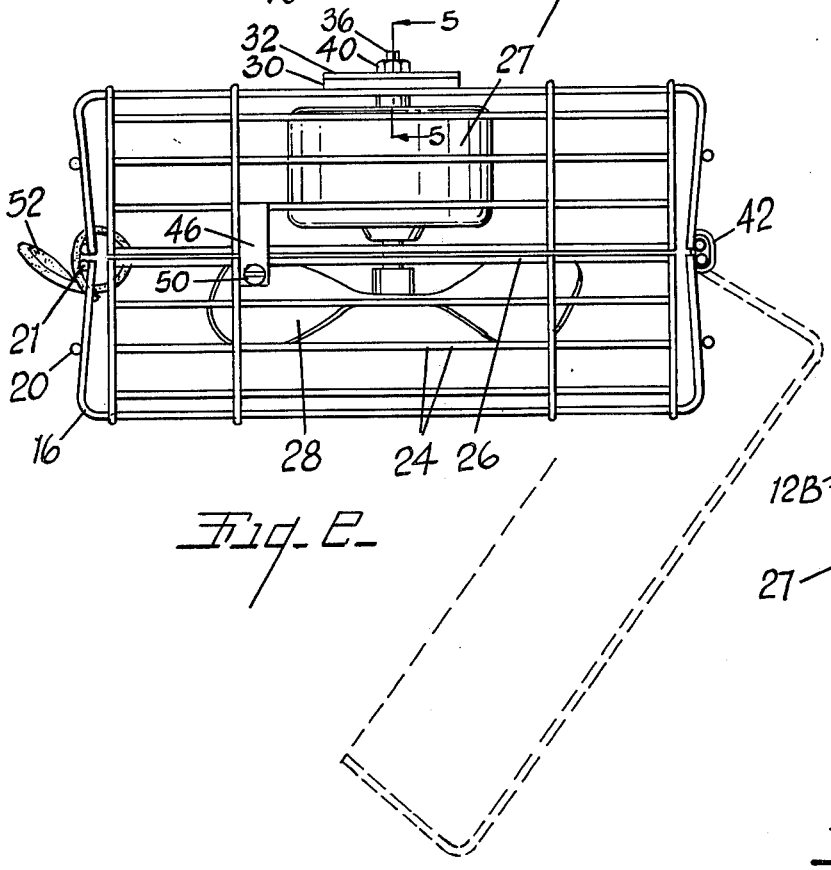
FIG. 2 is a top plan elevational view of the fan, with the guard shown in partially open position in dotted lines.

The front wall 10 in FIG. 1 is made up of a series of relatively closely spaced horizontal wires 12 connected by welding to four more widely spaced connecting wires 14. At each side end, the wires 12 curve rearwardly at 16 and project for half the depth of the box. The rearwardly turned ends 16 are connected by a vertically extending intermediate short connector wire 20 and at their terminal ends by another short connector wire 21. Note that the rearwardly bent ends 16 are bent for over 90°, so that short connecting wires 20 are further to the side and form supports for the fan and guard when it is set on any side.

The front connector wires 14 are turned rearwardly as at 22 and extend half way across the top and bottom ends of the box. The horizontally turned connector wires support and are welded to a series of short relatively closely spaced wires 24, with a terminal or marginal wire 26 located in lapped adjacent relation to the corresponding short wire on the rear half of the box when the guard is closed. The short wires 24 are spaced the same as the wires 12 and are as continuations of the grids formed by the wires 12. Note that the bends of the connector wires 20 are also more than 90° so that the top and bottom end walls of the box are recessed like the side ends.

Figure 5:
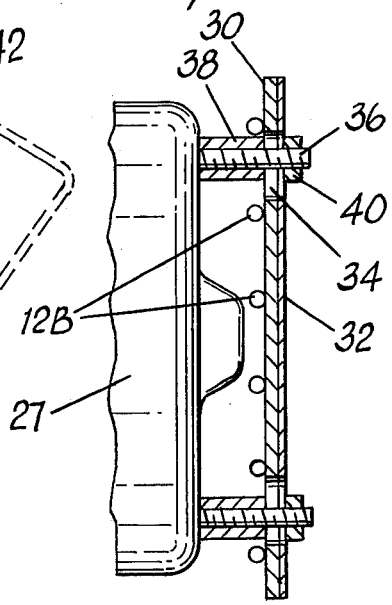
FIG. 5 is a fragmentary enlarged vertical cross sectional view through the motor mount and taken along the plane of the line 5—5 in FIG. 2.

As appears more clearly in FIG. 5, the motor 27 with the fan 28 mounted thereon is supported within the box of the guard mesh by a plate 30 welded to the outside of wires 12B on the back half of the guard box. The plate is vertically slotted as at 34 so that mounting screws 36 of different motors and at different spacing may be passed through the slots. Spacers 38 around the screws permit the nots 40 to clamp the motor to the plate which is welded to the wires. The reference numeral 32 indicates a name plate which may be clamped to the plate on the back of the box by the nuts 40.

Figure 4:
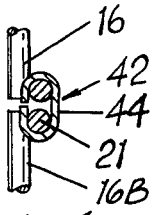
FIG. 4 is a fragmentary enlarged horizontal cross sectional view showing the hinge between the two halves of the guard and taken along the plane of the line 4—4 in FIG. 1.

As appears in FIG. 1 and more clearly in FIG. 4, the two halves of the guard box are connected by hinge elements 42. The hinges shown are short clips 44 bent into generally tubular form between the adjacent ends of the short rearwardly turned wires 16 and 16B of the two halves of the box. Other hinge elements may be used but these short clips function to both keep the wires 16 in end to end position, as well as permitting swinging movement between the marginal short connecting wires 20.

Figure 3:
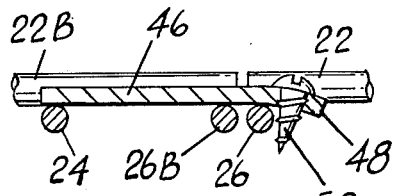
FIG. 3 is a fragmentary enlarged vertical cross sectional view taken along the plane of the line 3—3 in FIG. 1 and showing the details of one form of latch between the two halves of the guard.

Latches are provided in spaced relation to the hinges 42 to prevent the two halves of the guard from being opened. A wide variety of latches could be used, but should not be too easily openable so that the guard does not open accidentally, and so it can't be opened by small children. As is best shown in FIG. 3, short flat clips 46 are secured as by welding to the rearmost short horizontal wire 24 and the rear marginal wire 26 alongside of the interior connecting wire 22. An ear or tab 48 is bent inwardly of the box to overlie the adjacent wire 24B of the rear half of the guard box. The tab 48 has a tapped hole therethrough so that a screw 50 may be inserted therethrough to locking engagement under and behind the wire 26B. A similar latch is mounted on the bottoms of the two halves of the box.

Figure 6:
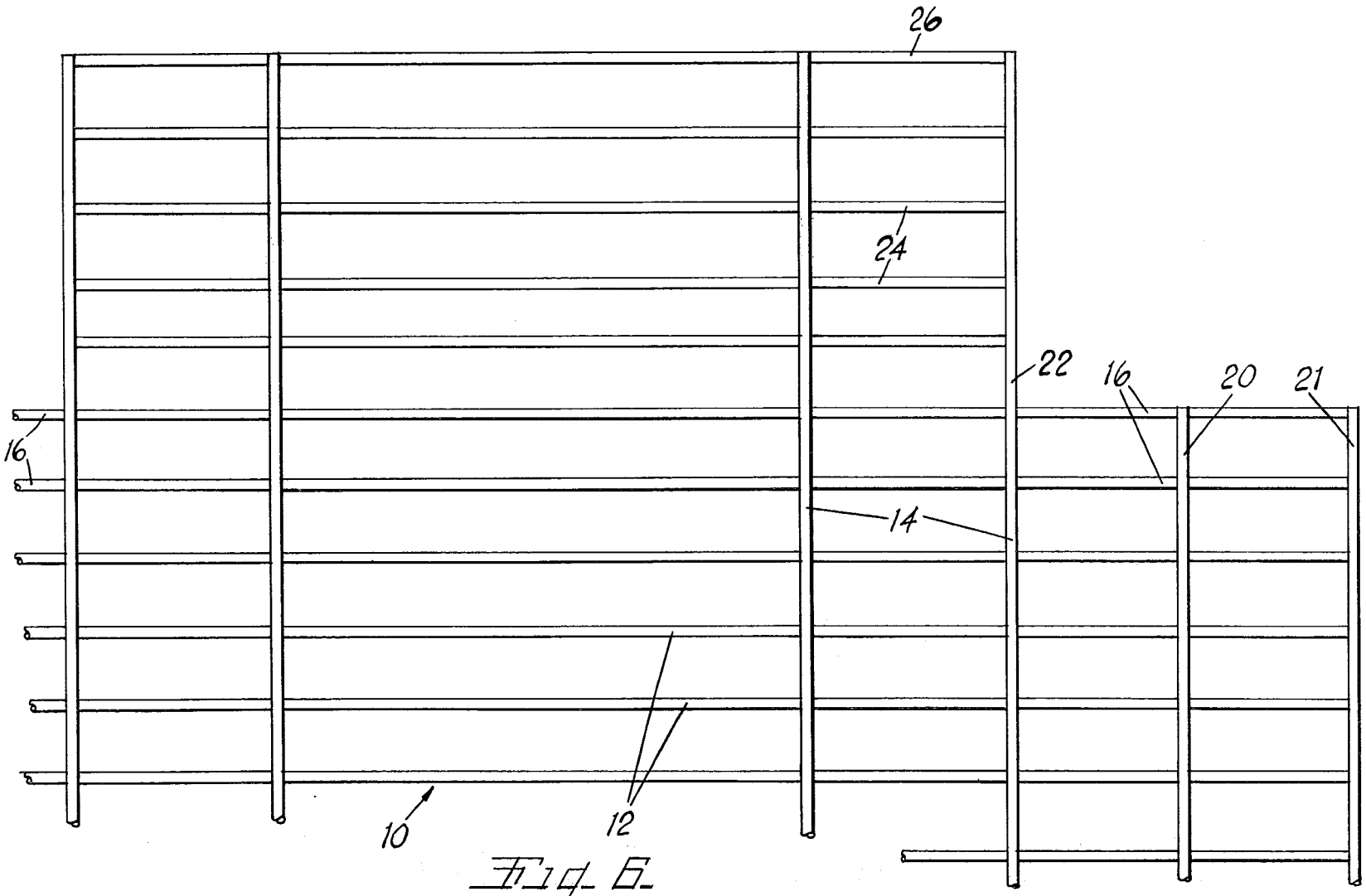
FIG. 6 is a fragmentary developed plan view showing the wire grid from which each half of the box-like guard grid is fabricated.

FIG. 6 shows how the grids for each half of the guard box may be easily welded together in the same shape and jigs, and later bent to form the front and back halves. Generally cross-shaped grid plates may be formed in the flat. The drawing identifies the parts of the grids with the same numbers they will assume when assembled. 52 is an elastic loop and is a handle which may be attached around a selected wire or wires of the guard for carrying the fan and for holding it closed relative to the hinged side.

What is claimed as new is:

1. A portable electric fan having a motor and a fan blade mounted within an enclosure, said enclosure comprising two identical box-like halves with short side walls on each edge of a square center wall, said halves being made from cruciform blanks of wire grid material having closely spaced parallel wires connected by more widely spaced crossing wires with marginal wires along the outer edges of the arms of the blanks, the arms of the blanks being bent inwardly in opposed relation to the ends of each other, with the ends of at least two opposed arms being bent at least 105° from the planes of the centers of the walls to which they are connected, hinge means connecting the marginal wires on the ends of said last two of said arms and recessed into said enclosure when the halves are closed, releasable latch means connecting the opposed ends of other opposed arms of said blanks in spaced relation to said hinge means, and a mounting plate welded to the center of one of said halves and receiving mounting connections from said motor.

2. A portable electric fan as defined in claim 1 in which all of the arms of each of said blanks are turned inwardly of said enclosure about 105° from the planes of the outer ends of said blanks.

* * * * *